US006434355B1

(12) United States Patent
Badesha et al.

(10) Patent No.: US 6,434,355 B1
(45) Date of Patent: Aug. 13, 2002

(54) TRANSFIX COMPONENT HAVING FLUOROSILICONE OUTER LAYER

(75) Inventors: Santokh S. Badesha, Pittsford; Edward L. Schluoter, Jr., Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 2 days.

(21) Appl. No.: 09/726,756

(22) Filed: Nov. 29, 2000

(51) Int. Cl.[7] ..... G03G 15/16

(52) U.S. Cl. ..... 399/307; 399/308; 399/333; 430/124

(58) Field of Search ..... 430/124; 399/307, 399/308, 333

(56) References Cited

U.S. PATENT DOCUMENTS 5,132,743 A 7/1992 Bujese et al. ..... 355/274
5,166,031 A 11/1992 Badesha et al. ..... 430/124
5,281,506 A 1/1994 Badesha et al. ..... 430/124
5,337,129 A 8/1994 Badesha ..... 355/275
5,340,679 A 8/1994 Badesha et al. ..... 430/126
5,361,126 A 11/1994 Loonen et al. ..... 355/279
5,370,931 A 12/1994 Fratangelo et al. ..... 428/334
5,366,772 A 1/1996 Badesha et al. ..... 525/104
5,480,938 A 1/1996 Badesha et al. ..... 525/104
5,500,298 A 3/1996 Badesha ..... 428/411.1
5,500,299 A 3/1996 Badesha ..... 428/447
5,537,194 A 7/1996 Henry et al. ..... 355/271
5,547,742 A * 8/1996 Satoh et al. ..... 428/215
5,576,818 A 11/1996 Badesha et al. ..... 355/271
5,716,714 A * 2/1998 Chen et al. ..... 428/473.5
5,750,204 A 5/1998 Badesha et al. ..... 427/387
5,753,307 A 5/1998 Badesha et al. ..... 427/387
5,837,340 A * 11/1998 Law et al. ..... 428/36.8
6,037,092 A * 3/2000 Heeks et al. ..... 430/124

* cited by examiner

*Primary Examiner*—Mark Chapman
(74) *Attorney, Agent, or Firm*—Annette L. Bade

(57) ABSTRACT

A transfix member with a substrate, an optional conformable intermediate layer, and thereover an outer fluorosilicone layer, and a heating member associated with the substrate.

16 Claims, 2 Drawing Sheets

TRANSFIX COMPONENT HAVING FLUOROSILICONE OUTER LAYER

BACKGROUND OF THE INVENTION

The present invention relates generally to an imaging apparatus and layers for components thereof, and for use in electrostatographic, including digital, apparatuses. The layers herein are useful for many purposes including layers for transfix films or transfuse films, and the like. More specifically, the present invention relates to a transfix or transfuse member comprising a substrate, and optional intermediate layer, and an outer layer comprising a fluorosilicone material. The transfix member of the present invention may be used in xerographic machines, especially color machines.

In a typical electrostatographic reproducing apparatus such as an electrophotographic imaging system using a photoreceptor, a light image of an original to be copied is recorded in the form of an electrostatic latent image upon a photosensitive member and the latent image is subsequently rendered visible by the application of a developer mixture. One type of developer used in such printing machines is a liquid developer comprising a liquid carrier having toner particles dispersed therein. Generally, the toner is made up of resin and a suitable colorant such as a dye or pigment. Conventional charge director compounds may also be present. The liquid developer material is brought into contact with the electrostatic latent image and the colored toner particles are deposited thereon in image configuration.

The developed toner image recorded on the imaging member can be transferred to an image receiving substrate such as paper via an intermediate transfer member. Alternatively, the developed image can be transferred to an intermediate transfer member from the image receiving member via another transfer member. The toner particles may be transferred by heat and/or pressure to an intermediate transfer member, or more commonly, the toner image particles may be electrostatically transferred to the intermediate transfer member by means of an electrical potential between the imaging member and the intermediate transfer member. After the toner has been transferred to the intermediate transfer member, it can then be transferred to the image receiving substrate, for example by contacting the substrate with the toner image on the intermediate transfer member under heat and/or pressure. Alternatively, the developed image can be transferred to another intermediate transfer member such as a transfix or transfer member. A transfix or transfuse member uses heat associated with the transfer member in order to both transfer and fix or fuse the developed image to a copy substrate.

Intermediate transfer members, including transfix or transfuse members, enable high throughput at modest process speeds. In four-color photocopier systems, the transfer member also improves registration of the final color toner image. In such systems, the four component colors of cyan, yellow, magenta and black may be synchronously developed onto one or more imaging members and transferred in registration onto a transfer member at a transfer station.

In electrostatographic printing machines in which the toner image is transferred from the transfix member to the image receiving or copy substrate, it is important that the transfer of the toner particles from the transfix member to the image receiving substrate be substantially 100 percent. Less than complete transfer to the image receiving substrate results in image degradation and low resolution. Completely efficient transfer is particularly important when the imaging process involves generating full color images since undesirable color deterioration in the final colors can occur when the color images are not completely transferred from the transfer member.

Thus, it is important that the transfix member surface has excellent release characteristics with respect to the toner particles. Conventional materials known in the art for use as transfix members often possess the strength, conformability and electrical conductivity necessary for use as transfix members, but can suffer from poor toner release characteristics, especially with respect to higher gloss image receiving substrates. When heat is associated with a transfer member, such as in the case of a transfix member, the transfix member must also possess good thermal conductivity in addition to superior release characteristics. Also, there is a need for mechanical strength for wear resistance. A transfix member undergoes multiple cycling during use.

In addition, in the event that electrically conductive fillers are needed to build electrical and thermal conductivities, and/or mechanical strength, it is necessary that the fillers be compatible with the materials used in the transfix member. Similarly, if release fluids are used, the materials in the transfix member and the fillers, if used, must be compatible with the release fluid materials. Also, the fillers, if used, and the materials in the transfix members must be chemically compatible with toners or liquid developers used in the electrostatographic apparatus.

U.S. patent application Ser. No. 09/375,592, filed Aug. 17, 1999, discloses a composition comprising a crosslinked product of a liquid composition which comprises (a) a fluorosilicone, (b) a crosslinking agent, and (c) a thermal stabilizing agent comprising a reaction product of (i) a cyclic unsaturated-alkyl-group-substituted polyorganosiloxane, (ii) a linear unsaturated-alkyl-group-substituted polyorganosiloxane, and (iii) a metal acetylacetonate or metal oxalate compound.

U.S. patent application Ser. No. 09/375,974, filed Aug 17, 1999, discloses a transfer member comprising a crosslinked product of a liquid composition which comprises (a) a fluorosilicone, (b) a crosslinking agent, and (c) a thermal stabilizing agent comprising a reaction product of (i) a cyclic unsaturated-alkyl-group-substituted polyorganosiloxane, (ii) a linear unsaturated-alkyl-group-substituted polyorganosiloxane, and (iii) a metal acetylacetonate or metal oxalate compound, said transfer member having surface a resistivity of from about $10^4$ to about $10^{16}$ ohms/square.

U.S. Pat. No. 5,361,126 discloses an imaging apparatus including a transfer member including a heater and pressure-applying roller, wherein the transfer member includes a fabric substrate and an impurity-absorbent material as a top layer. The impurity-absorbing material can include a rubber elastomer material.

U.S. Pat. No. 5,337,129 discloses an intermediate transfer component comprising a substrate and a ceramer or grafted ceramer coating comprised of integral, interpenetrating networks of haloelastomer, silicon oxide, and optionally polyorganosiloxane.

U.S. Pat. No. 5,340,679 discloses an intermediate transfer component comprised of a substrate and thereover a coating comprised of a volume grafted elastomer, which is a substantially uniform integral interpenetrating network of a hybrid composition of a fluoroelastomer and a polyorganosiloxane.

U.S. Pat. 5,480,938 describes a low surface energy material comprising a volume grafted elastomer which is a substantially uniform integral interpenetrating network of a hybrid composition of a fluoroelastomer and a polyorganosiloxane, the volume graft having been formed by dehydrofluorination of fluoroelastomer by a nucleophilic dehydrofluorinating agent, followed by a hydrosilation reaction, addition of a hydrogen functionally terminated polyorganosiloxane and a hydrosilation reaction catalyst.

U.S. Pat. No. 5,366,772 describes a fuser member comprising a supporting substrate, and a outer layer comprised of an integral interpenetrating hybrid polymeric network comprised of a haloelastomer, a coupling agent, a functional polyorganosiloxane and a crosslinking agent.

U.S. Pat. No. 5,456,987 discloses an intermediate transfer component comprising a substrate and a titamer or grafted titamer coating comprised of integral, interpenetrating networks of haloelastomer, titanium dioxide, and optionally polyorganosiloxane.

U.S. Pat. No. 5,848,327 discloses an electrode member positioned near the donor member used in hybrid scavengeless development, wherein the electrode members have a composite haloelastomer coating.

U.S. Pat. No. 5,576,818 discloses an intermediate toner transfer component including: (a) an electrically conductive substrate; (b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

U.S. Pat. No. 6,037,092 discloses a fuser member comprising a substrate and at least one layer thereover, the layer comprising a crosslinked product of a liquid composition which comprises (a) a fluorosilicone, (b) a crosslinking agent, and (c) a thermal stabilizing agent comprising a reaction product of (i) a cyclic unsaturated- alkyl-group-substituted polyorganosiloxane, (ii) a linear unsaturated-alkyl-group-substituted polyorganosiloxane, and (iii) a metal acetylacetonate or metal oxalate compound.

U.S. Pat. No. 5,537,194 discloses an intermediate toner transfer member comprising: (a) a substrate; and (b) an outer layer comprised of a haloelastomer having pendant hydrocarbon chains covalently bonded to the backbone of the haloelastomer.

U.S. Pat. No. 5,753,307 discloses fluoroelastomer surfaces and a method for providing a fluoroelastomer surface on a supporting substrate which includes dissolving a fluoroelastomer; adding a dehydrofluorinating agent; adding an amino silane to form a resulting homogeneous fluoroelastomer solution; and subsequently providing at least one layer of the homogeneous fluoroelastomer solution to the supporting substrate.

U.S. Pat. No. 5,840,796 describes polymer nanocomposites including a mica-type layered silicate and a fluoroelastomer, wherein the nanocomposite has a structure selected from the group consisting of an exfoliated structure and an intercalated structure.

U.S. Pat. 5,846,643 describes a fuser member for use in an electrostatographic printing machine, wherein the fuser member has at least one layer of an elastomer composition comprising a silicone elastomer and a mica-type layered silicate, the silicone elastomer and mica-type layered silicate form a delaminated nanocomposite with silicone elastomer inserted among the delaminated layers of the mica-type layered silicate.

Therefore, it is desired to provide a transfix member that possesses the qualities of conformability for copy quality and latitude, and also being tough for wear resistance. It is also desired to provide a transfer member that is electrically conductive to enable electrostatically assisted transfer. It is further desired to provide a transfer member that has low surface energy for release capability, and is chemically resistant to toner ingredients and release agents to enable efficient toner transfer. Preferably, the outer layer is resistant to branched aliphatic hydrocarbons used in liquid development. A further desired characteristic is for a transfer member to have a reduced susceptibility to swelling in the presence of release oils. An additional desired property for a transfix or transfuse member having heat associated therewith, is for the transfix member to be thermally stable for conduction for fusing or fixing.

SUMMARY OF THE INVENTION

The present invention provides, in embodiments, an image forming apparatus for forming images on a recording medium comprising: a) a charge-retentive surface to receive an electrostatic latent image thereon; b) a development component to apply a developer material to the charge-retentive surface to develop the electrostatic latent image to form a developed image on the charge-retentive surface; c) a transfer component for transferring the developed image from the charge-retentive surface to an intermediate transfer component; d) an intermediate transfer component for receiving the developed image from the transfer component and transferring the developed image to a transfix component; and e) a transfix component to transfer the developed image from the intermediate transfer component to a copy substrate and to fix the developed image to the copy substrate, the transfix component comprising: i) a transfix substrate, and having thereon ii) an outer transfix layer comprising a fluorosilicone material, and iii) a heating member associated with the transfix substrate.

Embodiments further include, a transfix member comprising: a) a transfix substrate, and thereover b) a conformable intermediate layer comprising a polymeric material, and having thereon c) an outer transfix layer comprising a fluorosilicone material, and d) a heating member associated with the transfix substrate.

Embodiments also include, an image forming apparatus for forming images on a recording medium comprising: a) a charge-retentive surface to receive an electrostatic latent image thereon; b) a development component to apply a developer material to the charge-retentive surface to develop the electrostatic latent image to form a developed image on the charge-retentive surface; c) a transfer component for transferring the developed image from the charge-retentive surface to an intermediate transfer component; d) an intermediate transfer component for receiving the developed image from the transfer component and transferring the developed image to a transfix component; and e) a transfix component to transfer the developed image from said intermediate transfer component to a copy substrate and to fix the developed image to the copy substrate, the transfix component comprising i) a transfix substrate comprising a material selected from the group consisting of metal and fabric, and thereover ii) a conformable intermediate layer comprising a material selected from the group consisting of fluoropolymers and silicone rubber materials, and having thereon iii) an outer transfix layer comprising a fluorosilicone material, and iv) a heating member associated with the transfix substrate.

BRIEF DESCRIPTION OF THE DRAWINGS

The above embodiments of the present invention will become apparent as the following description proceeds upon reference to the drawings, which include the following figures.

DETAILED DESCRIPTION OF THE INVENTION

The present invention is directed to transfix members having layers. The transfix members can be film components including films, sheets, belts and the like, useful in electrostatographic, including digital, apparatuses. In one embodiment of the present invention, a transfix member comprises a substrate, an optional intermediate layer, and an outer layer comprising a fluorosilicone material and optional electrically conductive fillers. In particularly preferred embodiments, the transfix substrate and/or the intermediate layer may comprise optional electrically conductive fillers. In another preferred embodiment, the intermediate layer may be conformable.

Figure 1:
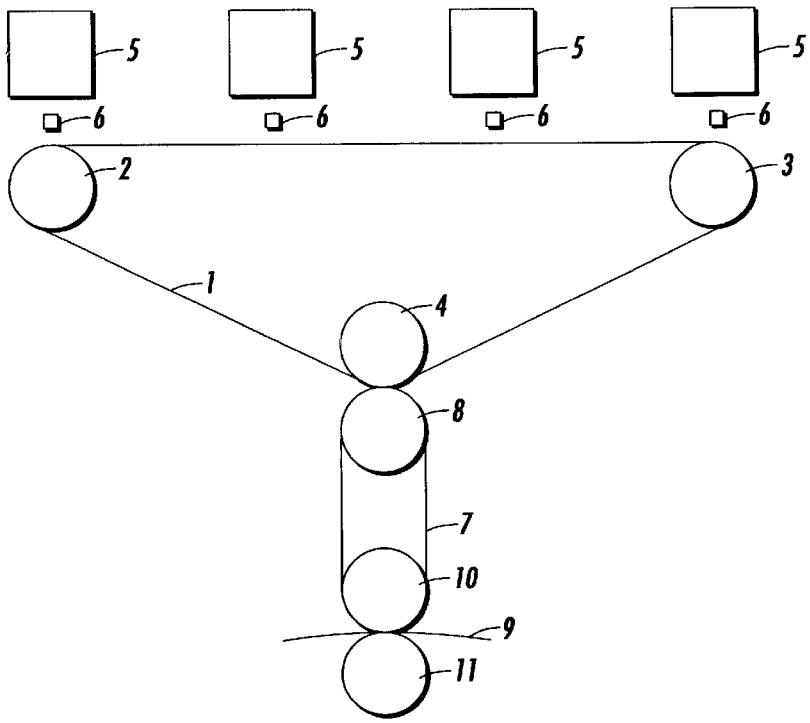
FIG 1 is an illustration of a general electrostatographic apparatus using a transfix member.

Referring to FIG. 1, there is depicted an image-forming apparatus comprising intermediate transfer member 1 advanced by rollers 2, 3 and 4. Intermediate transfer member 1 is depicted as a belt or film member, by may be of another useful form such as a belt, sheet, film, drum, roller or the like. An image is processed and developed by image processing units 5. There may be as few as 1 processing unit, for example, for 1 color processing such as black, and as many processing units as desired. In embodiments, each processing unit processes a specific color. In preferred embodiments, there are 4 processing units for processing cyan, black, yellow and magenta. The first processing unit processes one color and transfers this developed one-color image to the intermediate transfer member 1 via transfer member 6. The intermediate transfer member 1 is advanced to the next relevant processing unit 5 and the process is repeated until a fully developed image is present on the intermediate transfer member 1.

After the necessary number of images are developed by image processing members 5 and transferred to intermediate transfer member 1 via transfer members 6, the fully developed image is transferred to transfix member 7. The transfer of the developed image to transfix member 7 is assisted by rollers 4 and 8, either or both of which may be a pressure roller or a roller having heat associated therewith. In a preferred embodiment, one of 4 roller or 8 roller is a pressure member, wherein the other roller 4 or 8 is a heated roller. Heat may be applied internal or external to the roller. Heat may be supplied by any known heat source.

In a preferred embodiment, the fully developed image is subsequently transferred to a copy substrate 9 from transfix member 7. Copy substrate 9, such as paper, is passed between rollers 10 and 11, wherein the developed image is transferred and fused to the copy substrate by transfix member 7 via rollers 10 and 11. Rollers 10 and/or 11 may or may not contain heat associated therewith. In a preferred embodiment, one of rollers 10 and 11 contains heat associated therewith in order to transfer and fuser the developed image to the copy substrate. Any form of known heat source may be associated with roller 10 and/or 11.

Figure 2:
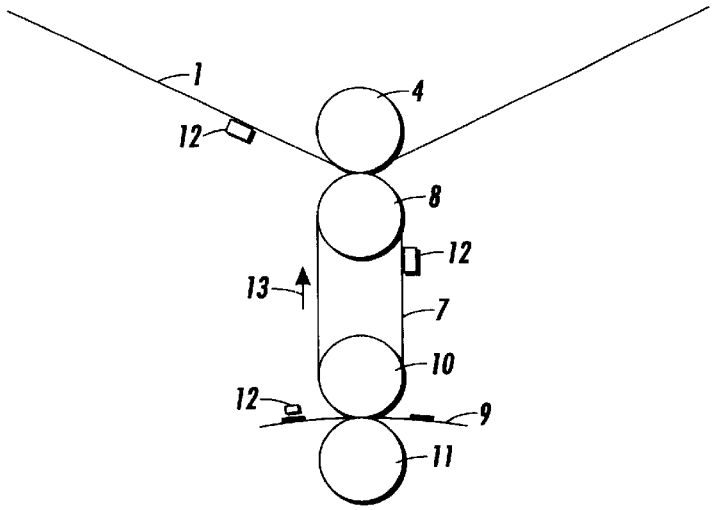
FIG 2 is an enlarged view of an embodiment of a transfix system.

FIG. 2 demonstrates an enlarged view of a preferred embodiment of a transfix member 7 which may be in the form of a belt, sheet, film, roller, or like form The developed image 12 positioned on intermediate transfer member 1,is brought into contact with and transferred to transfix member 7 via rollers 4 and 8. As set forth above, roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

Figure 3:
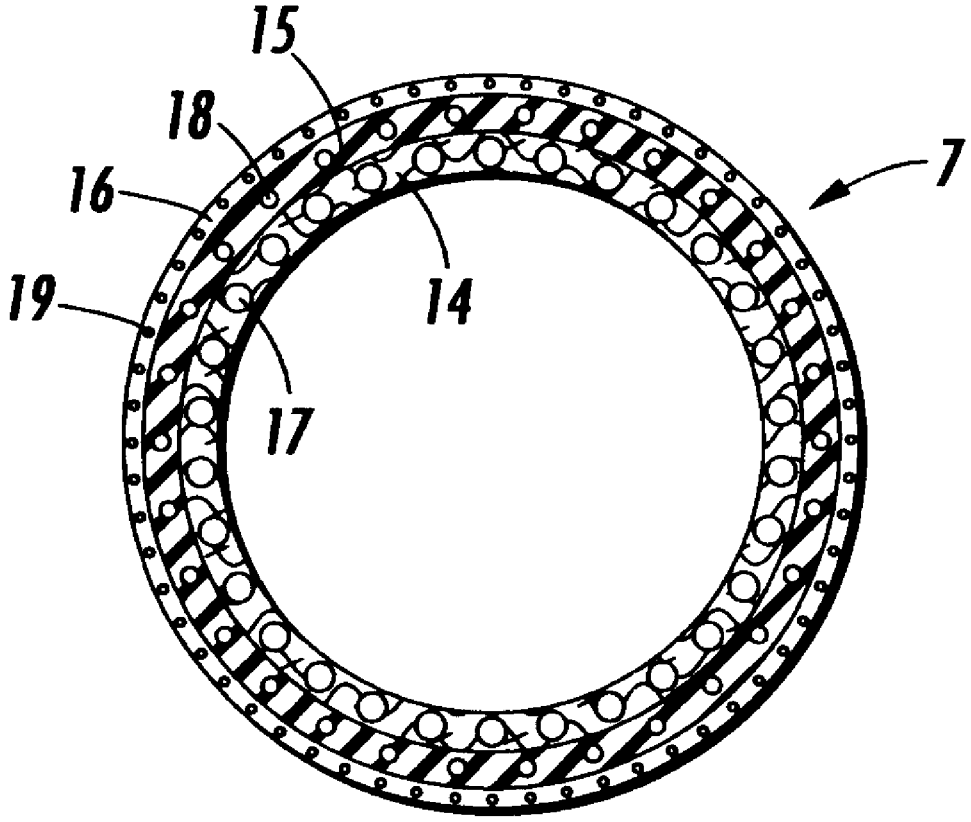
FIG 3 is an enlarged view of a preferred embodiment of a transfix belt configuration involving a substrate, an intermediate layer, and thin outer layer.

FIG. 3 demonstrates a preferred embodiment of the invention, wherein transfix member 7 comprises substrate 14, having thereover intermediate layer 15. Outer layer 16 is positioned on the intermediate layer 15. In preferred embodiments, the substrate 14 may comprise electrically conductive fillers 17. In another embodiment, the intermediate layer may comprise electrically conductive fillers 18. In yet another embodiment, the outer layer may comprise electrically conductive fillers 19. Substrate 14, in preferred embodiments, comprises metal or fabric. In a preferred embodiment, the substrate comprises a fabric material, the intermediate layer 15 is a conformable elastic layer, and the outer layer 16 is a thin overcoat. In another preferred embodiment, the substrate 14 comprises a metal, the intermediate layer 15 is a thin layer, and the outer layer 16 is a thin overcoat.

The transfix outer layer(s) herein comprise an outer release layer comprising a fluorosilicone material. With certain toners and release agents, non-compatable materials are desired for use as the outer layer to minimize swell and increase life. For example, when dimethyl silicone oil was used as a release agent, a conformable dimethylsilicone transfix coating was shown to swell, leading to shortened life. Alternatively, the inventors have found that a fluorosilicone material used as an outer release layer will impart release properties, minimize swell and increase mechanical life. Another example involves special toners that contain hydrocarbon fluids. These toners tend to swell when used with dimethylsilicone coating. However, minimum swell has been shown with fluorsilicone materials.

Fluorosilicone materials have also been shown to be more conformable and have better release properties than fluoropolymers such as fluoroelastomers, and in particular, terpolymers and tetrapolymers sold under the tradename VITON™.

As a single coating, a fluorosilicone can be applied to substrates in a range from about 75 to about 400 microns but is limited in the upper limit for electrical transfer reasons. Most preferred non-conductive coating thickness are from about 75 to about 300 microns. To increase the thickness of the coating, a conductive fluorosilicone or conductive intermediate layer needs to be added to achieve proper fields for electrostatic transfer.

The hardness of the fluorosilicone material is typically from about 10 to about 70 Shore A, with a preferred range being from about 35 to about 60 Shore A. The conformability of the transfix component is always a trade off between the modulus and thickness of the component coat materials.

Examples of suitable fluorosilicone materials include those resistant to branched aliphatic hydrocarbons used in liquid developers such as those used as non-polar insulating solvents sold under the tradenames ISOPAR™ and NORPAR™ by Exxon Chemical Corporation. The release layer preferably also exhibits minimal or no swelling in the liquid carrier and the conductivity of the release layer preferably is not affected by or is minimally affected in the presence of a liquid carrier.

Examples of suitable fluorosilicones include those listed in U.S. Pat. Nos. 5,132,743 and 5,576,818, the disclosures of which are hereby incorporated by reference in their entirety. Preferred fluorosilicones include those having the following formula:

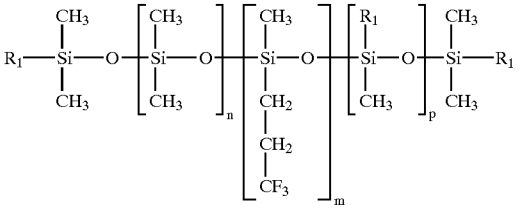

wherein $R_1$ can be methyl, vinyl, hydroxy, and alkoxy such as methoxy, ethoxy, propoxy, and the like. In a preferred embodiment, when one $R_1$ substituent is methyl, the other two $R_1$ substituents preferably are other than methyl. In a particularly preferred embodiment, $R_1$ is vinyl. The subscripts m, n, and p are integers having a total value of from about 350 to about 3500, preferably from about 705 to about 2025; where m may be an integer which ranges, for example, from about 175 to about 1725, and preferably from about 350 to about 1000; n may be an integer which ranges for example from about 175 to about 1725, preferably from about 350 to about 1000; and p ranges from about 0 to about 50, preferably from about 5 to about 25.

Examples of suitable commercially available fluorosilicones include those sold by Dow Corning as DC 5-8749 and DC 94-003. The structural formulas of the two Dow Corning fluorosilicones are believed to be encompassed by the general fluorosilicone formula discussed herein. It is further believed that the fluorosilicones having the above formulation exhibit superior swell resistance in aliphatic hydrocarbons as compared to known silicone rubber outer release layer materials. It is desired that the outer layer material be resistant to swell, because swelling tends to weaken a material and causes inferior wear and shorter life of the transfix member.

The fluorosilicone is present in the outer transfix layer in an amount of from about 95 to about 35 percent, preferably from about 90 to about 50 percent, and particularly preferred is from about 80 to about 70 percent by weight of total solids. Total solids as used herein refers to the total amount by weight of fluorosilicone material, doped metal oxide filler, and any additional additives, fillers or like solid materials.

The layers, including the substrate, the optional intermediate layer and/or the outer release layer, in embodiments, may comprise electrically conductive particles dispersed therein. These electrical conductive particles decrease the material resistivity into the desired resistivity range. The desired surface resistivity is from about $10^6$ to about $10^{14}$, preferably from about $10^9$ to about $10^{13}$, and more preferably from about $10^{10}$ to about $10^{12}$ ohms/sq. The preferred volume resistivity range is from about $10^5$ to about $10^{14}$, preferably from about $10^8$ to about $10^{14}$, and particularly preferred is from about $10^{12}$ to about $10^{14}$ ohm-cm. The desired resistivity can be provided by varying the concentration of the conductive filler. It is important to have the resistivity within this desired range. The transfix components may exhibit undesirable effects if the resistivity is not within the required range. Other problems include resistivity that is susceptible to changes in temperature, relative humidity, and the like.

If an insulative fluorosilicone is used, the thickness is typically from about 25 to about 250 microns with a preferred range of from about 25 to about 75 microns. In a particularly preferred embodiment, this insulative top coat is preferably coated over a conductive intermediate layer that is about $10^8$ ohm-cm in volume resistivity.

Examples of conductive filers for use in the outer layer, include conventional electrically conductive fillers such as metals, metal oxides, carbon blacks, and conductive polymers such as polyanaline, polypyrroles, polythiophenes, and the like, and mixtures thereof In a preferred embodiment of the invention, the electrically conductive filler is carbon black and/or indium tin oxide. The optional conductive filler is present in the layer in an amount of from about 1 to about 30 percent, preferably from about 2 to about 20 percent by weight of total solids in the layer.

The substrate can comprise any material having suitable strength and flexibility for use as a transfix member, enabling the member to cycle around rollers during continuous use of the machine. Preferred materials for the substrate include metals, rubbers and fabrics. Preferred metals include steel, aluminum, nickel, and their alloys, and like metals and alloys of like metals. Examples of suitable rubbers include ethylene propylene dienes, silicone rubbers, fluoroelastomers, n-butyl rubbers and the like.

A fabric material, as used herein, refers to a textile structure comprised of mechanically interlocked fibers or filaments, which may be woven or nonwoven. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. The fabric material should have high mechanical strength and possess electrical insulating properties.

Examples of suitable fabrics include woven or nonwoven cotton fabric, graphite fabric, fiberglass, woven or nonwoven polyimide (for example KELVAR® available from DuPont), woven or nonwoven polyamide, such as nylon or polyphenylene isophthalamide (for example, NOMEX® of E.I. DuPont of Wilmington, Del.), polyester, aramids, polycarbonate, polyacryl, polystyrene, polyethylene, polypropylene, cellulose, polysulfone, polyxylene, polyacetal, and the like, and mixtures thereof.

Preferably, the substrate is of a thickness of from about 20 to about 65 mils, and preferably from about 40 to about 60 mils.

The substrate may comprise an optional electrically conductive filler. Suitable fillers include metals, metal oxides, doped metal oxides, polymer fillers, carbon blacks, and mixtures thereof. Preferably, the substrate comprises fillers such as carbon black, indium tin oxide or mixtures thereof.

In an optional embodiment, an intermediate layer may be positioned between the substrate and the outer layer. Materials suitable for use in the intermediate layer include silicone materials, fluoroelastomers, fluorosilicones, ethylene propylene diene rubbers, and the like. In a particularly preferred embodiment, the intermediate layer further comprises a thermal or electrically conductive filler. Suitable fillers include carbon black (a preferred example is fluorinated carbon, such as those sold under the tradename ACCUFLUOR®), metals, metal oxides, doped metal oxides, and mixtures thereof. Preferred fillers for the intermediate layer include aluminum oxide, boron nitride, carbon black and zinc oxide.

It is preferred that the intermediate layer be conformable and be of a thickness of from about 2 to about 60 mils, and preferably from about 4 to about 25 mils.

Examples of suitable transfix members include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, and the like. It is preferred that the substrate having the outer layer thereon, be an endless seamed flexible belt or seamed flexible belt, which may or may not include puzzle cut seams.

The transfix film, preferably in the form of a belt, has a width, for example, of from about 150 to about 2,000 mm, preferably from about 250 to about 1,400 mm, and particularly preferred is from about 300 to about 500 mm. The circumference of the belt is preferably from about 75 to about 2,500 mm, more preferably from about 125 to about 2,100 mm, and particularly preferred from about 155 to about 550 mm.

Specific embodiments of the invention will now be described in detail. These examples are intended to be illustrative, and the invention is not limited to the materials, conditions, or process parameters set forth in these embodiments. Al parts are percentages by weight of total solids as defined above unless otherwise indicated.

EXAMPLES

Example 1

Preparation of Fluorosilicone Outer Layer on Metal Belt with Volume Graft Intermediate Layer Polyimide substrates (thickness about 3 mils), filled with indium tin oxide, having resistivity of about $10^{10}$ ohms/sq were obtained from E.I. DuPont de Nemours & Company and were tape seamed into a belt shape. General Electric Co. adhesive GE2872-074 was then applied to a thickness of 0.2 to 0.3 mil (approximately 5 to 7.5 micrometers), air dried at ambient conditions for 30 minutes and baked at 150° C. for 30 minutes.

Subsequently, the primed belts were provided with a coating of a Volume Graft elastomer which was prepared by dissolving 250 grams of VITON GF® in 2.5 liters of methylethyl ketone (MEK) by stirring at room temperature for 1 to 2 hours. The above solution was then transferred to a 5 liter Erlenmeyer flask and 25 milliliters of the amine dehydrofluorinating agent (3-(N-strylmethyl-2-aminoethylamino) propyltrimethoxysilane hydrochloride, S-1590, available from Huls America Inc. Piscataway, N. J.) was added. The contents of the flask were then stirred using a mechanical stirrer while maintaining the temperature between 55 and 60° C. After stirring for 30 minutes, 50 milliliters of 100 centistoke vinyl terminated polysiloxane (PS-441 also available from Huls America Inc.) was added and stirring was continued for another ten minutes. A solution of 10 grams of benzoyl peroxide in a 100 ml mixture of toluene and MEK (80:20) was then added. The stirring was continued while heating the contents of the flask at about 55° C. for another 2 hours. During this time, the color of the solution turned light yellow. The solution was then poured into an open tray. The tray was left in the hood overnight (about 16 hours). The resulting yellow rubbery mass left after the evaporation of the solvent was then cut into small pieces with scissors. This material was then extracted extensively and repeatedly with 1,500 ml (three 500 ml portions) of n-hexane to remove unreacted siloxane. Thereafter, 110 grams of the prepared silicone grafted fluoroelastomer, together with 1000 grams of methyl isobutyl ketone and 22 grams of Regal R250 carbon black available from Cabot Corporation, were added to a jar containing ceramic balls (media) followed by roll milling for 48 hours. To the above mixture, 2.2 grams of magnesium oxide and 1.10 gram of calcium hydroxide $(CaOH)_2$ were added, and the contents of the jar were ball milled for an additional 17 to 24 hours until a fine, 3 to 5 microns in diameter particle-sized fillers in dispersion was obtained. Subsequently, 5.0 grams of DuPont Curative VC50 catalyst crosslinker in 45 parts of methyl ethyl ketone were added to the above dispersion, shaken for about 15 minutes, and the solids content reduced to 5 to 7 percent by the addition of methyl isobutyl ketone. Following hand mixing, the mixture was air sprayed on to the above primed belts to a dry thickness of about 4.5 mils (112.5 micrometers) and cured in ambient dry air for 24 hours, followed by the following post step curing procedure: heating for 2 hours at 93° C., heating for 2 hours at 149° C., heating for 2 hours at 177° C., and thereafter heating for 16 hours at 208° C., followed by cooling.

A layer of General Electric Co. adhesive GE2872-074 was then applied to both the belts as before to a thickness of 0.2 to 0.3 mil (5 to 7.5 micrometers).

To the above belts, a top coat of fluorosilicone polymer was fabricated by the following techniques. Fluorosilicone LSR kit, Q5-8601 was obtained from Dow Corning Co., having a chemical formula believed to be encompassed by the general fluorosilicone structure disclosed herein. The kit contained fluorosilicone LSR, in two parts, part A and Part B. Both part A and B were added to 2000 grams of methyl isobutyl ketone in a ball jar containing ceramic media followed by ball milling for 1 hour. The resulting dispersion was then spray coated on the above belt to a dry thickness of 2 mils. The fluorosilicone top layer was then cured in ambient dry air for 24 hours followed by heating at 110° C. The resulting belt was comprised of resistive polyimide as substrate, volume graft/carbon black middle layer, and fluorosilicone as the top layer.

Example 2

Preparation of Fluorosilicone Outer Layer on Metal Belt with Fluoroelastomer Intermediate Layer A belt having a stainless steel substrate, an intermediate layer comprising a fluoroelastomer, and an overcoat of fluorosilicone was prepared as follows. A solution of a fluoroelastomer (VITON B500®) was prepared by dissolving 500 grams of the B50 in 5 liters of methylethyl ketone (MEK) and stirred at room temperature, about 25° C. The following were added to 5 liters of this solution: 4.4 grams of magnesium oxide, 2.2 grams of calcium hydroxide, 11 grams of E.l DuPont Curative VC50®, and 10 grams of carbon black N991 obtained from Vanderbilt Corporation. The contents of the vessel were ball milled with media for 17 hours. The resulting black dispersion containing the VITON® B50 was then spray coated to a dry thickness of about 6 mils onto a stainless steel belt (thickness about 3 mils).

To the above belts, a top coat of fluorosilicone polymer was fabricated by the following techniques. Fluorosilicone LSR kit, Q5-8601 was obtained from Dow Corning Co., having a chemical formula believed to be encompassed by the general fluorosilicone structure disclosed herein. The kit contained fluorosilicone LSR, in two parts, part A and Part B. Both part A and B were added to 2000 grams of methyl isobutyl ketone in a ball jar containing ceramic media followed by ball milling for 1 hour. The resulting dispersion was then spray coated on the above belt to a dry thickness of 2.0 mils. The fluorosilicone top layer was then cured in ambient dry air for 24 hours followed by heating at 110° C. The resulting belt was comprised of resistive polyimide as substrate, Flouroelastomer/carbon black middle layer, and fluorosilicone as the top layer.

Example 3

Preparation of Fluorosilicone Outer Layer on Metal Belt

A stainless steel belt was primed with General Electric adhesive GE-2872-074 and an overcoat of fluorosilicone polymer was fabricated by the following techniques. Fluorosilicone LSR kit, Q5-8601 was obtained from Dow Corning Co., having a chemical formula believed to be encompassed by the general fluorosilicone structure disclosed herein. The kit contained fluorosilicone LSR, in two parts, part A and Part B. Both part A and B were added to 2000 grams of methyl isobutyl ketone in a ball jar containing ceramic media followed by ball milling for 1 hour. The resulting dispersion was then spray coated on the above belt to a dry thickness of 6 mils. The fluorosilicone overcoat was then cured in ambient dry air for 24 hours followed by heating at 110° C. The resulting belt was comprised of stainless steel as substrate and fluorosilicone as an overcoat.

Example 4

Preparation of Transfix Belts

The belts prepared in Examples 1-3 were then incorporated into a two belt, dry development, transfuse fixture. The belt temperatures were maintained at about 120° C. It was observed that from about 97 to about 98 percent of the toner was transferred from this belt to the paper. On repeated cycling, the toner transfer efficiency did not degrade indicating that this belt would have extended release life for a viable product.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. An image forming apparatus for forming images on a recording medium comprising:

a) a charge-retentive surface to receive an electrostatic latent image thereon;

b) a development component to apply a developer material to said charge-retentive surface to develop said electrostatic latent image to form a developed image on said charge-retentive surface;

c) a transfer component for transferring said developed image from said charge-retentive surface to an intermediate transfer component;

d) an intermediate transfer component for receiving said developed image from said transfer component and transferring said developed image to a transfix component; and e) a transfix component to transfer the developed image from said intermediate transfer component to a copy substrate and to fix said developed image to said copy substrate, said transfix component comprising:

i) a transfix substrate, having thereon ii) an outer transfix layer comprising a fluorosilicone material, and iii) a heating member associated with said transfix substrate.

2. The image forming apparatus of claim 1, wherein said fluorosilicone material has the following formula:

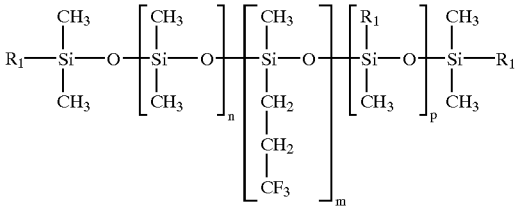

wherein $R_1$ is selected from the group consisting of methyl, vinyl, hydroxy, and alkoxy, and wherein m, n and p are integers having a total value of from about 350 to about 3,500.

3. The image forming apparatus of claim 2, wherein said alkoxy is selected from the group consisting of methoxy, ethoxy and propoxy.

4. The image forming apparatus of claim 2, wherein $R_1$ is vinyl.

5. The image forming apparatus of claim 2, wherein m is an integer of from about 175 to about 1725, n is an integer of from about 175 to about 1725, and p is an integer of from about 0 to about 50.

6. The image forming apparatus of claim 2, wherein when one $R_1$ substituent is methyl, the other two $R_1$ substituents are other than methyl.

7. The image forming apparatus of claim 1, wherein said outer transfix layer further comprises a conductive filler.

8. The image forming apparatus of claim 7, wherein said conductive filler is selected from the group consisting of metals, metal oxides, carbon blacks, conductive polymers, and mixtures thereof.

9. The image forming apparatus of claim 8, wherein said conductive filler is selected from the group consisting of indium tin oxide, carbon black, and a mixture of indium tin oxide and carbon black.

10. The image forming apparatus of claim 1, wherein said transfix substrate comprises a metal.

11. The image forming apparatus of claim 1, wherein said transfix substrate comprises a fabric material.

12. The image forming apparatus of claim 11, wherein said fabric material is selected from the group consisting of nonwoven cotton fabric, graphite fabric, fiberglass, woven polyimide, nonwoven polyimide, woven polyamide, nonwoven polyamide, polyester, aramids, polycarbonate, polyacryl, polystyrene, polyethylene, polypropylene, cellulose, polysulfone, polyxylene, polyacetal, and mixtures thereof.

13. The image forming apparatus of claim 1, further comprising a conformable intermediate layer positioned between said substrate and said outer layer.

14. The image forming apparatus of claim 1, wherein said conformable intermediate layer comprises a material selected from the group consisting of fluoropolymers and silicone rubbers.

15. The image forming apparatus of claim 14, wherein said intermediate layer comprises a conductive filler selected from the group consisting of carbon blacks, metal oxides, metals, conductive polymers, and mixtures thereof.

16. An image forming apparatus for forming images on a recording medium comprising:

a) a charge-retentive surface to receive an electrostatic latent image thereon;

b) a development component to apply a developer material to said charge-retentive surface to develop said electrostatic latent image to form a developed image on said charge-retentive surface;

c) a transfer component for transferring said developed image from said charge-retentive surface to an intermediate transfer component;

d) an intermediate transfer component for receiving said developed image from said transfer component and transferring said developed image to a transfix component; and e) a transfix component to transfer the developed image from said intermediate transfer component to a copy substrate and to fix said developed image to said copy substrate, said transfix component comprising:

i) a transfix substrate comprising a material selected from the group consisting of metal and fabric, and thereover ii) a conformable intermediate layer comprising a material selected from the group consisting of fluoropolymers and silicone rubber materials, and having thereon iii) an outer transfix layer comprising a fluorosilicone material, and iv) a heating member associated with said transfix substrate.

* * * * *